United States Patent [19]

Attems

[11] Patent Number: 4,590,979

[45] Date of Patent: May 27, 1986

[54] DEVICE FOR BARK-PEELING TREE TRUNKS OR THE LIKE

[76] Inventor: Franz Attems, Anton Kleinoschegstrasse 8, A-8051 Graz, Austria

[21] Appl. No.: 697,590

[22] PCT Filed: Apr. 27, 1984

[86] PCT No.: PCT/AT84/00014

§ 371 Date: Jan. 8, 1985

§ 102(e) Date: Jan. 8, 1985

[87] PCT Pub. No.: WO84/04485

PCT Pub. Date: Nov. 22, 1984

[30] Foreign Application Priority Data

May 10, 1983 [AT] Austria ..... 1717/83

[51] Int. Cl.[4] ..... B27L 1/00

[52] U.S. Cl. ..... 144/208 F; 144/340

[58] Field of Search ..... 144/208 R, 208 E, 208 F, 144/208 G, 340

[56] References Cited

U.S. PATENT DOCUMENTS

| | | | |
|---|---|---|---|
| 2,230,336 | 2/1941 | Taylor et al. | 144/208 F |
| 2,689,591 | 9/1954 | Woodard | 144/208 F |
| 2,726,691 | 12/1985 | Harwood et al. | 144/208 F |
| 2,934,112 | 4/1960 | Valo | 144/208 F |

FOREIGN PATENT DOCUMENTS 742608 12/1943 Fed. Rep. of Germany .

*Primary Examiner*—W. D. Bray

*Attorney, Agent, or Firm*—Watson, Cole, Grindle & Watson

[57] ABSTRACT

A tree trunk debarking apparatus includes two straight rails, a supporting carriage which is movable along the rails and which loosely supports the leading end of the tree trunk, a drive carriage which is movable along the rails and which not only supports the trailing end of the tree trunk but also rotates the tree trunk, and a debarking mechanism for debarking the rotating tree trunk as it moves therepast, the debarking mechanism including a rotating knife roller and a pivot arm which supports the knife roller so that it is oriented at an acute angle relative to the longitudinal dimension of the rails and thus the axis of the tree trunk passing thereby.

9 Claims, 6 Drawing Figures

DEVICE FOR BARK-PEELING TREE TRUNKS OR THE LIKE

BACKGROUND OF THE INVENTION

1. Field of the Invention

The invention relates to a device for bark-peeling (debarking) tree trunks and the like, and in particular to such a debarking device which has a rotating bark-peeling tool that comprises a knife roller provided with skinning knives and which is mounted on a pivot arm so as to be displaceable or pivotable towards the tree trunk, the tree trunk from which the bark is to be peeled being displaceable relative to the bark-peeling tool in the direction of its longitudinal axis with the aid of wheels guided on rails and which is rotated about its axis by means of a driving apparatus.

2. The Prior Art

The peeling of bark from tree trunks and large branches is still frequently performed even at present by arduous manual labour. The main reason for this would appear to be that no sufficiently simple and transportable machine is available which will permit bark removal in situ, i.e. immediately following felling in the forest. Conveying the trunks to the fixed bark-removal plants is awkward and expensive. In addition, for reasons of space, many fixed bark-removal plants can only work with tree trunks of limited length.

Various devices for bark-peeling tree trunks are already known in which a rotating knife roller which is provided with skinning knives is mounted on a pivot arm—see U.S. Pat. Nos. 1,986,708 and 3,416,581, as well as French Pat. No. 1,125,189. The tree trunk from which the bark is to be peeled is moved past the knife roller and is rotated about its axis. In the case of the known devices the knife roller is mounted on the pivot arm in such a way that its axis of rotation extends either in the longitudinal direction of the tree trunk or at a right angle thereto. The tree trunk itself is supported on rollers which are driven in a revolving manner in order to rotate the tree trunk. With these known devices only tree trunks which have grown relatively straight may have their bark peeled, since, in the case of tree trunks with a pronouncedly non-circular cross-section or with an axis extending in a curve, the pivot arm supporting the knife roller must make excessive pivoting movements on account of the rotational movements of the tree trunk, so as to permit satisfactory treatment. In addition, the known drives are relatively complicated, so that they are suitable practically only for stationary operation.

Furthermore, it is known, in the case of machines for processing tree trunks, to arrange the skinning knives in single- or multiple-thread helices on the surface of the knife roller. In a known design (German Published Specification No. 2,712,985), skinning bands, which are supplemented by knife bands extending on the surface of the roller in the axial direction, are arranged on a holding means which extends helically. In a similar known design (see German Pat. No. 961,208) the helical skinning knives have a complicated profile, which consists of radial cutters, a comb surface, a cutting edge and a groove. There, too, the axis of rotation of the knife roller extends axially parallel to the tree trunks to be processed. In addition, the skinning knives used are complicated and quickly wear out, so that they must be re-ground. In some designs some depth-limiting means are required in order to prevent excessively deep penetration of the skinning knives into the tree trunk.

SUMMARY OF THE INVENTION

The object of the invention is to improve the hitherto known devices for bark-peeling tree trunks in such a way that individual processing is possible even for those tree trunks which are not yet grown and which are provided with knots, and, in addition, to provide a device which has a simple design and is easy to convey, so that it may be set up at the felling site and may be driven.

The device according to the invention consists of an advantageous combination of design features and is characterized in that a holding apparatus with the driving apparatus for rotating the tree trunk is provided at one end of the tree trunk and a supporting apparatus for loosely supporting the tree trunk is provided in the region of the knife roller, the axis of rotation of the knife roller extends at an acute angle to the axis of the tree trunk and the skinning knives consist in a known manner per se of flat bars which are mounted on edge in single- or multiple-thread helices on the surface of the knife roller and which project beyond the surface of the roller and with their outer surface extend concentric to the latter.

The combination of features according to the invention produces an arrangement set up surprisingly simply, by means of which long wood of any length and any type may nevertheless have its bark peeled off. Since the tree trunk is loosely supported during processing only in the region of the knife roller, non-circular tree trunks and those which have grown bent can be processed without difficulty. The relatively small pivot movements occurring in the region of the knife roller may be compensated for by the pivot arm without adversely affecting the processing quality, so as to always ensure a complete peeling of the bark from the tree trunk. The free end of the tree trunk may swing out unhindered. Knots and the beginnings of roots may be removed in one operation with the bark removal, it being possible to select the intensity of processing and the depth of skinning by regulating the advancing movement and the rotational speed of the tree trunk and the rotational speed of the knife roller according to requirements. Sensors and supports for setting the skinning depth are unnecessary. The bark is forced away with the rear of the knife, so that the skinning knife cannot bite into the wood of the tree trunk and even highly soiled wood, for example having small stones adhering to the bark, may be processed without danger. The skinning knives are sharpened during the processing itself. The direction of rotation of the knife roller and that of the tree trunk to be processed are advantageously opposite one another.

In a further embodiment of the invention the holding apparatus may be mounted on a driving carriage, which runs on rails and which is provided—in the advancing direction of the tree trunk from which the bark is to be peeled—in front of the knife roller, supports the driving apparatus for rotating the tree trunk and may be moved towards the knife roller in a manner known per se with the aid of an advancing device. By means of this holding apparatus the tree trunk to be processed is held only at one of its ends, is rotated about its axis and is advanced towards the knife roller. At its other end the tree trunk is freely movable, so that it can swing out with this end if its axis extends in a curve.

The supporting apparatus may be disposed on a supporting carriage which may be locked in the region of the knife roller, and a delivery carriage, which preferably comprises a trough-like chute which receives the processed end of the tree trunk, may be guided freely displaceably on rails in the advancing direction of the tree trunk behind the knife roller so as to receive the end of the tree trunk from which the bark has been peeled. In this connexion, the supporting apparatus already supports the front end of the tree trunk before the beginning of processing. The supporting carriage is then moved along with the tree trunk on the rails as far as the region of the knife roller and there it is braked, after which the tree trunk slides over the supporting carriage. Its end from which the bark has been peeled is caught by the delivery carriage. In this connection a simple and advantageous embodiment of the supporting carriage consists in a support member arranged transversely to the advancing direction and having a rounded surface which is preferably curved downwardly and forms a sliding guide for the tree trunk.

In a preferred embodiment of the invention the driving apparatus for rotating the tree trunk comprises a rotating twist drill and a stop surface with projecting prongs which surrounds the latter concentrically. When it encounters the front end of the tree trunk, the twist drill, which is turned by the driving apparatus, is screwed into the tree trunk, until the prongs bear firmly on the tree trunk and set it in motion. If the driving apparatus is provided with a reverse gear, the finished tree trunk can be released from the holding apparatus simply by reversing the twist drill.

The knife roller, the driving apparatus on the driving carriage and the associated advancing apparatus are advantageously actuated by a central control desk preferably disposed in the region of the bark-peeling tool. This makes it possible for the entire bark-peeling device to be controlled by a single person, who can regulate the depth of bark peeling in a simple manner by adjusting and adapting the rate of advance. Where possible, the individual devices are driven by means of electrical power, but one or more individual motors may also be provided. It is also possible to supply the drive by a tractor, for example with the aid of the power take-off shaft thereof. Finally, the device according to the invention may be made at least partially collapsible, and it may be displaceably mounted on a frame provided with wheels. This permits easy transport, so that the device for bark-peeling tree trunks may be set up directly at the site of felling.

DESCRIPTION OF THE DRAWINGS

A preferred embodiment of the device according to the invention is explained in greater detail in the drawing, in which.

DETAILED DESCRIPTION OF THE PREFERRED EMBODIMENT

Figure 1:
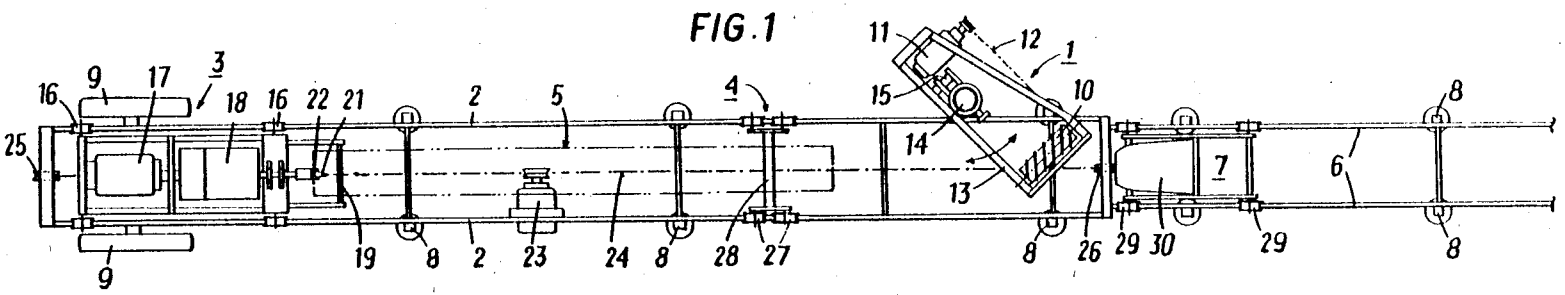
FIG. 1 is a diagrammatic plan view of the preferred embodiment of debarking device according to the invention.

As seen in FIG. 1 the device for bark-peeling tree trunks comprises a bark-peeling tool 1 and rails 2 which are arranged below the latter and on which a driving carriage 3 and a supporting carriage 4 are displaceably mounted. The tree trunk 5 to be processed, which is indicated in dash-dot lines in FIGS. 1 and 2, rests with its ends on the driving carriage 3 and the supporting carriage 4, which hold it during processing, move it past the bark-peeling tool 1 and support it. Further rails 6, on which a delivery carriage 7 is displaceable, are provided on the other side of the bark-peeling tool 1. The rails 2 and 6 are mounted on supports 8. The rails 6 are arranged slightly lower than the rails 2. In addition, in the region of its left-hand end, the device illustrated is provided with conveying wheels 9.

The bark-peeling tool 1 comprises a knife roller 10 which is provided with skinning knives and which is rotated by a motor 11 by way of a chain 12. Together with its drive motor 11, the knife roller 10 is secured to a pivot arm 13 which is held vertically pivotably on a column 14 by means of a pivot bearing 15. The pivot arm 13 may also be displaced vertically on the column 14 and may be set at various levels, and it is also horizontally pivotable about the axis of the column 14. In this way it is possible for the knife roller 10 to be brought into the correct position in each case for processing tree trunks 5 of different sizes.

The driving carriage 3 runs on the rails 2 with the aid of four wheels 16. Arranged consecutively on the rails 2 in the axial direction of the tree trunk 5 to be processed are a drive motor 17, a continuously variable transmission 18 and a holding apparatus 19 which may be pivoted vertically with the aid of a control spindle 20 in order to bring the end of the tree trunk 5 into the desired position. A short twist drill 21 with a stop surface 22, which is provided with axially projecting prongs, is disposed above the holding apparatus 19. For the purpose of advancing the driving carriage 3 a cable traction drive is provided which is visible in particular in FIG. 2 and comprises a drive motor 23, a cable line 24 and cable pulleys 25 and 26. The ends of the cable line 24 are secured to the driving carriage 3.

Figure 4:
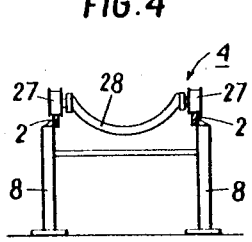
FIG. 4 is a section along the line IV—IV of FIG. 2.

The supporting carriage 4, an elevation of which may be seen in FIG. 4, is of simple design. It consists merely of four wheels 27 running on the rails 2 and a support 28 which connects the latter and which is bent downwardly and advantageously has a rounded surface.

Figure 5:
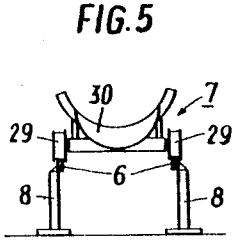
FIG. 5 is a section along the line V—V of FIG. 2.

In addition, the delivery carriage 7, which may be seen in FIG. 5 in particular, is provided with four wheels 29 which run on the rails 6 and is provided with a trough-like chute 30. The end of the chute 30 facing the bark-peeling tool 1 extends under the rails 2, so that it can catch the end of the tree trunk 5 from which the bark has been peeled and which is arriving from the bark-peeling tool 1.

Figure 6:
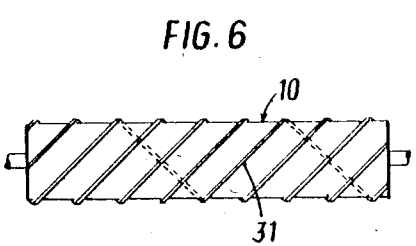
FIG. 6 is a view of the knife roller of the bark-peeling tool of the device according to the invention.

FIG. 6 shows a preferred embodiment of the knife roller 10. The skinning knives are formed by flat bars 31 which are mounted on edge in four helical paths on the surface of the knife roller 10. On its exterior the helical flat bars 31 are twisted coaxially to the surface of the knife roller 10. In this way advantageous cutting surfaces are produced, which effect an advantageous peeling of the bark from the tree trunk, without penetrating too deep into the latter.

Figure 2:
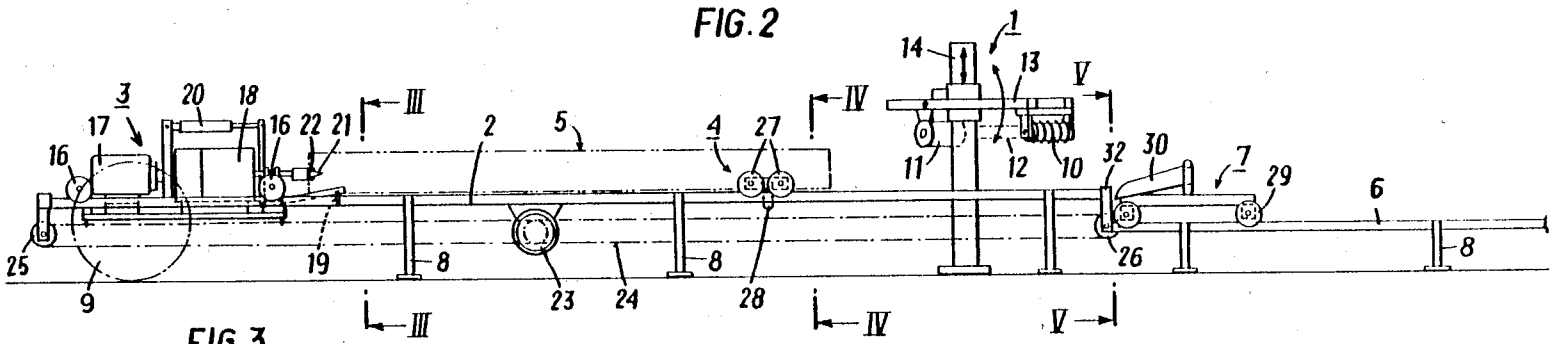
FIG. 2 is a side view of the debarking device as shown in FIG. 1.
Figure 3:
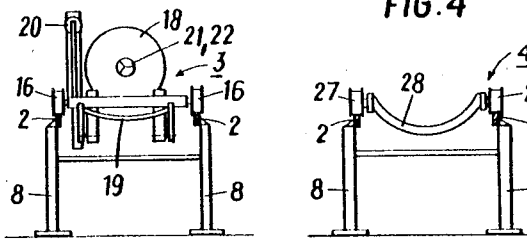
FIG. 3 is a section along the line III—III of FIG. 2.

The tree trunk 5 from which the bark is to be peeled is inserted into the bark-peeling device in the manner shown in FIGS. 1 and 2. One of its ends is laid on the driving carriage 3 and the other end is laid on the supporting carriage 4. The end resting on the driving carriage 3 is then orientated with the aid of the holding apparatus 19 and the control spindle 20 in such a way that the axis of the tree trunk 5 is aligned approximately on the twist drill 21. If the latter is rotated by means of the drive motor 17 and the transmission 18 and at the same time the driving carriage 3 is displaced forwards towards the bark-peeling tool 1 by means of the cable line 24, the twist drill 21 penetrates into end face of the tree trunk 5 until the stop surface 22 bears against the tree trunk 5. The prongs provided on the stop surface 22 penetrate into the tree trunk, so that it is entrained and turned about its axis. When the driving carriage 3 is advanced further, the front end of the tree trunk 5 reaches into the region of the bark-peeling tool 1 and in that region below the knife roller 10. The latter is disposed at an acute angle, preferably under 45°, to the axis of the tree trunk 5 and is driven in a rotating manner in such a way that the skinning knives mounted on its surface move over the surface of the tree trunk 5 contrary to its direction of rotation. While it is being guided through below the knife roller 10, which rests on the tree trunk 5 by virtue of its own weight, the tree trunk has its bark progressively peeled off.

On account of the pivotable suspension of the knife roller 10 with the aid of the pivot arm 13 the knife roller 10 can automatically adjust itself to different thicknesses of the tree trunks from which the bark has been peeled. In addition, the knife roller 10 can compensate for irregularities and, in the case of curved tree trunks, it can follow the vertical movements which are produced by the curved tree trunks during the rotational movement about their axis. The supporting carriage 4 is designed in such a way that it does not obstruct the movements of the tree trunk 5. It is first of all moved along by the tree trunk and conveyed below the knife roller 10. After passing the bark-peeling tool 1 the supporting carriage 4 bears against an end stop 32 at the end of the rails 2. The tree trunk 5 from which the bark has been peeled then slides over the supporting carriage 4, the support member 28 of which is made correspondingly round. The end of the tree trunk 5 from which the bark has been peeled is then caught by the trough-like chute 30 of the delivery carriage 7 which runs on the rails 6. The delivery carriage 7 thus ensures that the tree trunk from which the bark has been peeled is properly conveyed away from the bark-peeling tool 1. As soon as the entire tree trunk 5 has passed through the bark-peeling tool 1 the advancing movement of the driving carriage 3 is stopped and the direction of rotation of the twist drill 21 is reversed, so that it unscrews itself from the tree trunk 5. The tree trunk from which the bark has been peeled may then be conveyed away. The driving carriage 3, the supporting carriage 4 and the delivery carriage 7 are brought back to their starting positions shown in the drawing, after which a new tree trunk may be inserted into the bark-peeling device and the bark-peeling process may begin once more.

The bark-peeling device according to the invention operates independently of the type of wood of the tree trunk from which the bark is to be peeled and also independently of its dimensions. In this connection the tree trunks may have their bark peeled off to any desired thickness or even be completely skinned. The depth of bark peeling or skinning may be set and changed simply by changing the advancing speed of the driving carriage 3 relative to to the rotational speed of the tree trunk 5 from which the bark has been peeled and of the knife roller 10. In this way it is possible for the depth of bark removal to be adapted to the respective nature of the tree trunk from which the bark has been peeled and even for irregular tree trunks to be processed precisely. The entire arrangement, in particular the knife roller, the driving apparatus on the driving carriage and the associated advancing device are advantageously actuated by way of a centrally arranged control desk, so that the entire bark-peeling process may be supervised and controlled by a single person.

I claim:

1. An apparatus for debarking tree trunks, said device comprising a primary support means for the tree trunk to be debarked, said primary support means comprising a pair of straight primary rails which have corresponding first ends and corresponding second ends; a supporting carriage which includes wheels mounted on said primary rails and which loosely supports a leading end of said tree trunk, said supporting carriage being movable along said primary rails to convey said leading end of the free trunk toward said corresponding second ends of said rails; a driving device which supports the trailing end of a tree trunk, said driving device being movable to convey said tree trunk toward said corresponding second ends of said primary rails, said driving device including rotator means for gripping the trailing end of said tree trunk and rotating said tree trunk, and a debarking mechanism located near the corresponding second ends of said primary rails, said debarking mechanism including a rotatable knife roller which includes a cylindrical member defining a central axis therethrough and flat bars extending helically around said cylindrical member, the flat bars having outer surfaces which extend coaxially with respect to said central axis; and a pivot arm which supports said rotatable knife roller, said pivot arm being capable of supporting said knife roller above and between said primary rails such that its axis extends at an acute angle with respect to the longitudinal extent of said primary rails.

2. The debarking apparatus as defined in claim 1, wherein said driving device comprises a driving carriage which includes wheels that are mounted on said primary rails.

3. The debarking apparatus as defined in claim 2 including first drive means connected to said driving carriage to move it along said primary rails.

4. The debarking apparatus as defined in claim 1, including an end stop means at the corresponding second ends of said primary rails to prevent movement of said supporting carriage therepast.

5. The debarking apparatus as defined in claim 1, including a secondary support means for the debarked tree trunk, said secondary support means comprising a pair of straight secondary rails which extend in the same longitudinal direction as said pair of primary rails, said secondary rails having corresponding first ends positioned adjacent the corresponding second ends of said primary rails; and a delivery carriage having wheels mounted on said secondary rails and a trough-like chute for receiving the tree trunk which has been debarked by said rotatable knife roller.

6. The debarking apparatus as defined in claim 1, wherein said supporting carriage includes a support member which extends transversely of said primary rails and is curved to conform generally to the outer surface of a tree trunk.

7. The debarking apparatus as defined in claim 1, wherein said rotator means comprises a rotating twist drill having a stop surface.

8. The debarking apparatus as defined in claim 1, wherein said debarking mechanism includes a column member which extends above said primary rails, and wherein said pivot arm is movable along the length of said column member and is also movable therearound.

9. The debarking apparatus as defined in claim 8, wherein said debarking mechanism includes a second drive means connected to said knife roller to rotate said knife roller.

* * * * *